US008746207B2

(12) United States Patent
Drew et al.

(10) Patent No.: US 8,746,207 B2
(45) **Date of Patent: *Jun. 10, 2014**

(54) AUTOMATIC CHOKE FOR AN ENGINE

(71) Applicant: Briggs and Stratton Corporation, Wauwatosa, WI (US)

(72) Inventors: Christopher J. Drew, West Allis, WI (US); David W. Branski, Muskego, WI (US); Chad J. Gartzke, Richfield, WI (US); William H. Mayer, Hubertus, WI (US); Benjamin R. Miller, Hartland, WI (US); Dawn N. Traynor, West Allis, WI (US); Gene Zimmerman, Cedarburg, WI (US); Jean-Paul Benjamins, Brookfield, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/934,916

(22) Filed: Jul. 3, 2013

(65) Prior Publication Data

US 2013/0291845 A1 Nov. 7, 2013

Related U.S. Application Data

(63) Continuation of application No. 12/821,888, filed on Jun. 23, 2010, now Pat. No. 8,495,995.

(51) Int. Cl.
*F02M 1/02* (2006.01)
*F02D 41/06* (2006.01)

(52) U.S. Cl.
USPC ..... 123/276; 123/179.18; 261/39.3; 181/272

(58) Field of Classification Search
USPC ..... 123/179.16, 179.18, 437, 676; 261/39.1, 39.3; 181/272
See application file for complete search history.

(56) References Cited

U.S. PATENT DOCUMENTS

| | | | |
|---|---|---|---|
| 1,996,802 | A | 4/1935 | Fitzgerald |
| 2,086,023 | A | 7/1937 | Fitzgerald |

(Continued)

FOREIGN PATENT DOCUMENTS

| | | |
|---|---|---|
| EP | 1323916 | 7/2003 |
| JP | 07145757 | 6/1995 |

(Continued)

OTHER PUBLICATIONS

Briggs & Stratton Company, Service Manual for Out of Production Engines 1919-1981, published at least as early as 1985, pp. 56, 57, and 60.

(Continued)

*Primary Examiner* — Willis R Wolfe, Jr.
(74) *Attorney, Agent, or Firm* — Michael Best & Friedrich LLP

(57) ABSTRACT

An internal combustion engine includes a muffler configured to reduce exhaust gas noise. The muffler has a housing defining an interior and an exterior. A choke valve is configured to control a flow of air in a carburetor and a thermally responsive element is coupled with the choke valve and configured to move the choke valve in response to a temperature change in the thermally responsive element. A thermally conductive member has a first portion positioned in the interior of the muffler and extending through the muffler housing to the exterior of the muffler, and a second portion positioned exteriorly of the muffler and coupled to the thermally responsive element. The thermally conductive member is configured to conduct heat from exhaust gases within the muffler to the thermally responsive element.

22 Claims, 3 Drawing Sheets

(56) References Cited

U.S. PATENT DOCUMENTS

| | | | |
|---|---|---|---|
| 2,139,355 | A | 12/1938 | Coffey |
| 2,548,334 | A | 4/1951 | Armstrong |
| 3,161,186 | A | 12/1964 | Reichenbach et al. |
| 3,194,224 | A | 7/1965 | Lechtenberg et al. |
| 3,305,223 | A | 2/1967 | Reichenbach |
| 3,315,949 | A | 4/1967 | Sutton |
| 3,319,943 | A | 5/1967 | Morgan |
| 3,789,815 | A | 2/1974 | Schreiner |
| 3,828,745 | A | 8/1974 | Medrick |
| 3,834,677 | A | 9/1974 | Hosho |
| 3,863,614 | A | 2/1975 | Thompson et al. |
| 3,886,241 | A | 5/1975 | Schubeck |
| 3,898,967 | A | 8/1975 | Bennett et al. |
| 3,957,026 | A | 5/1976 | Winkley et al. |
| 3,970,059 | A | 7/1976 | Pisar |
| 4,023,550 | A | 5/1977 | Houston |
| 4,031,872 | A | 6/1977 | Thompson et al. |
| 4,050,427 | A | 9/1977 | Hollins |
| 4,068,636 | A | 1/1978 | Nau et al. |
| 4,221,202 | A | 9/1980 | Wick |
| 4,297,980 | A | 11/1981 | Bellis |
| 4,368,163 | A | 1/1983 | Covey, Jr. |
| 4,848,082 | A | 7/1989 | Takahashi et al. |
| 5,069,180 | A | 12/1991 | Schmidt et al. |
| 5,503,125 | A | 4/1996 | Gund |
| 5,511,519 | A | 4/1996 | Watson et al. |
| 6,012,420 | A | 1/2000 | Dykstra et al. |
| 6,145,487 | A | 11/2000 | Dykstra et al. |
| 6,722,638 | B2 | 4/2004 | Kojima et al. |
| 6,932,055 | B2 | 8/2005 | Rado |
| 6,990,969 | B2 | 1/2006 | Roth et al. |
| 7,144,000 | B2 | 12/2006 | Roth et al. |
| 8,261,712 | B2 | 9/2012 | Sotiriades |
| 8,495,995 | B2 * | 7/2013 | Drew et al. ..... 123/676 |
| 2009/0301072 | A1 | 12/2009 | Sotiriades |

FOREIGN PATENT DOCUMENTS

| | | |
|---|---|---|
| JP | 7158510 | 6/1995 |
| SU | 828982 | 5/1981 |
| SU | 1373330 | 2/1988 |

OTHER PUBLICATIONS

Briggs & Stratton Company, Illustrated Parts List for Model Series 142300 to 142457, published at least as early as 1965, pp. 3, 9, 10, 14, and 15.

Briggs & Stratton Company, Illustrated Parts List for Model Series 19D, 19D-B, 19D-FB, 19D-R6, and 19D-R6D, published at least as early as 1965, pp. 3, 8, and 10.

* cited by examiner

AUTOMATIC CHOKE FOR AN ENGINE

RELATED APPLICATIONS

This application is a continuation of U.S. application Ser. No. 12/821,888 filed Jun. 23, 2010, now U.S. Pat. No. 8,495,995.

BACKGROUND

The present invention relates to small internal combustion engines, especially those utilizing a carburetor, such as engines in a lawnmower or a snow blower. Cold temperature starting of the engine requires a more fuel-rich fuel-air mixture in the intake manifold of the engine to sustain the combustion reaction. In some engines, this is done by closing a choke valve, thereby partially choking off the air supply to the engine. As the engine warms up, the choke is no longer necessary because the increased temperatures in the engine help to sustain the combustion reaction and thus the choke is opened, allowing more air into the intake manifold. In many small engines, the choke valve is actuated manually.

Typically during warm engine restarts, the choke must remain open to start the engine and to prevent the engine from stumbling or stalling. During cold starts, if the choke valve is opened too soon, the engine may stall because the fuel-air mixture is not rich enough to sustain the reaction. If the choke remains closed too long, the engine may also stumble and excessive hydrocarbon emissions and fouling of the spark plugs can occur.

SUMMARY

In one construction, the invention provides an internal combustion engine including a muffler configured to reduce exhaust gas noise, a choke valve configured to control a flow of air in a carburetor, a thermally responsive element coupled with the choke valve and configured to move the choke valve in response to a temperature change in the thermally responsive element, and a thermally conductive member. The muffler has a housing defining an interior and an exterior. The thermally conductive member has a first portion positioned in the interior of the muffler in direct contact with the exhaust gases and extends through the muffler housing to the exterior of the muffler. The thermally conductive member also has a second portion positioned exteriorly of the muffler and coupled to the thermally responsive element, the thermally conductive member configured to conduct heat from exhaust gases within the muffler to the thermally responsive element.

In one construction, the invention provides an internal combustion engine that includes a muffler configured to reduce exhaust gas noise. The muffler has a housing defining an interior and an exterior. A choke valve is configured to control a flow of air in a carburetor and a thermally responsive element is coupled with the choke valve and configured to move the choke valve in response to a temperature change in the thermally responsive element. A thermally conductive member has a first portion positioned in the interior of the muffler and extending through the muffler housing to the exterior of the muffler, and a second portion positioned exteriorly of the muffler and coupled to the thermally responsive element. The thermally conductive member is configured to conduct heat from exhaust gases within the muffler to the thermally responsive element.

In another construction, the invention provides an internal combustion engine that includes a muffler configured to reduce exhaust gas noise. The muffler has a housing that defines an interior and an exterior. A choke valve is configured to control a flow of air in a carburetor and a thermally responsive element is coupled to the choke valve and configured to move the choke valve in response to a temperature change in the thermally responsive element. A thermally conductive member has a first portion positioned in the interior of the muffler in a thermal exchange relationship with the exhaust gases and extending through the muffler housing to the exterior of the muffler, and a second portion positioned exteriorly of the muffler and coupled to the thermally responsive element. The thermally conductive member is configured to conduct heat from exhaust gases within the muffler to the thermally responsive element.

In another construction, the invention provides an internal combustion engine that includes a muffler having a housing defining an interior and an exterior, the interior including an inlet space adjacent a muffler inlet and an outlet space adjacent a muffler outlet. A choke valve is configured to control a flow of air in a carburetor and a thermally conductive member has a first portion positioned in the inlet space and a second portion positioned in the exterior of the muffler. A temperature of the thermally conductive member varies in response to the temperature of an exhaust gas passing through the muffler. A thermally responsive element is coupled to the choke valve and to the second portion of the thermally conductive member such that a temperature of the thermally responsive element varies with the temperature of the thermally conductive element. The thermally responsive element positions the choke valve in response to the temperature of the thermally responsive element.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
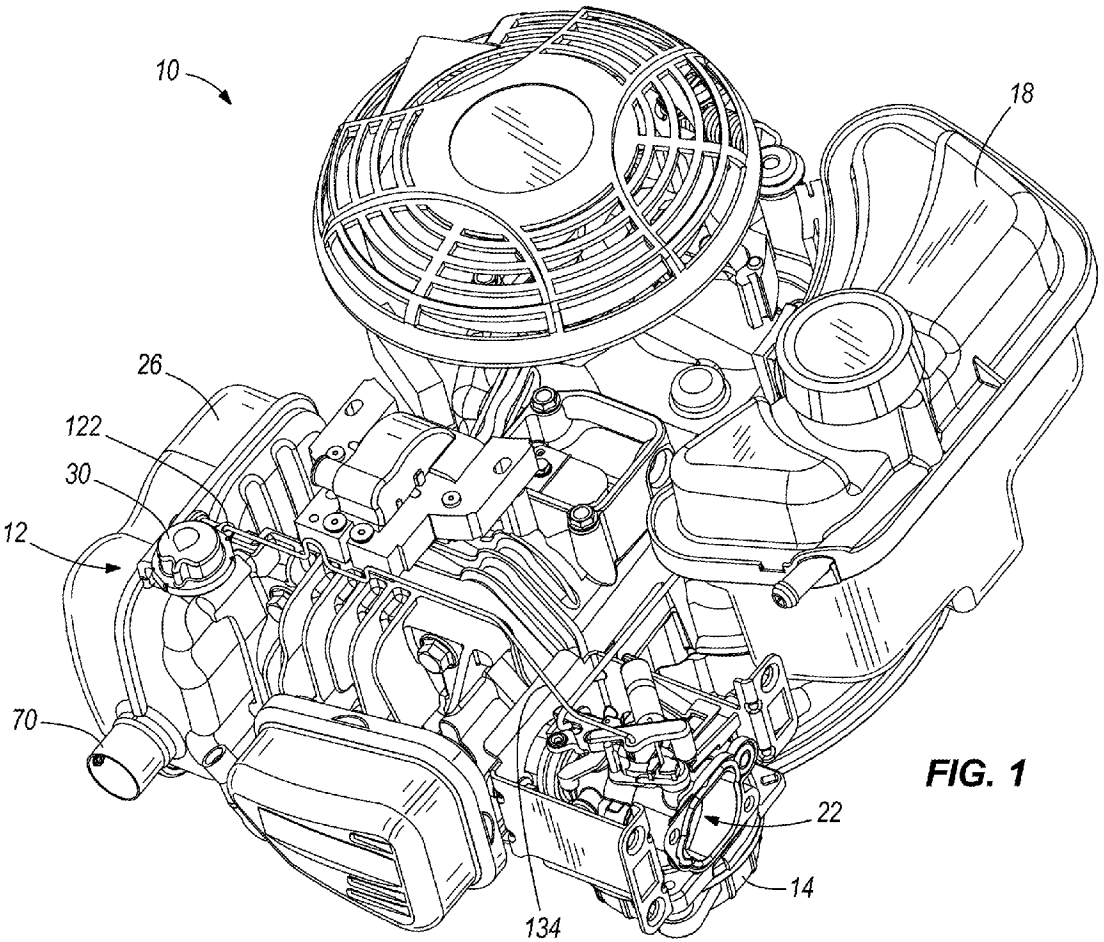
FIG. 1 is a perspective view of an internal combustion engine including an automatic choke apparatus embodying the present invention.

FIG. 1 illustrates an internal combustion engine 10 having an automatic choke apparatus 12 according to one construction of the invention. The engine 10 includes a carburetor 14 for mixing fuel and air to be combusted in the engine 10, and a fuel tank 18 contains fuel for delivery to the carburetor 14. The engine 10 also includes a choke valve 22, which constricts the flow of air through the carburetor 14 to control a vacuum for metering the amount of fuel drawn into the fuel-air mixture. The engine 10 also includes a muffler 26 for quieting exhaust gases, and a thermally conductive assembly 30 is coupled between the muffler 26 and the choke valve 22 for moving the choke valve 22 in response to a temperature of exhaust gases in the muffler 26, as will be described in greater detail below. The automatic choke apparatus 12 includes the thermally conductive assembly 30 coupled to the choke valve 22 by way of a linkage 134.

Figure 2:
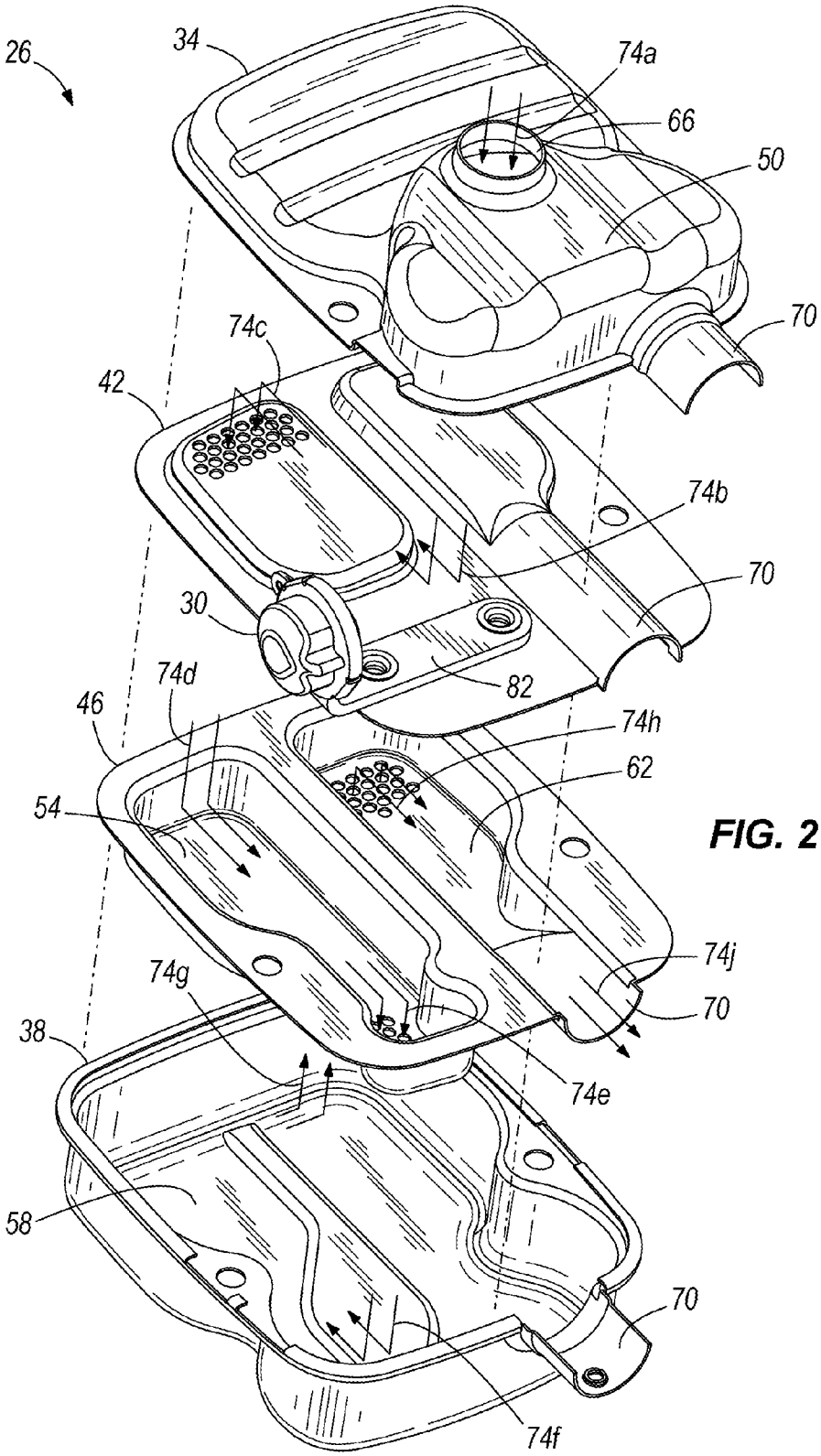
FIG. 2 is an exploded view of a muffler and a portion of the automatic choke apparatus of FIG. 1.

FIG. 2 illustrates the muffler 26. In the illustrated construction, the muffler 26 includes a housing, such as a clamshell housing, including a first housing half 34 and a second housing half 38. The housing 34, 38 defines an interior and an exterior of the muffler 26. The muffler 26 also includes a first wall 42 or baffle, and a second wall 46 or baffle, that cooperate with the housing 34, 38 to define and separate first, second, third and fourth chambers 50, 54, 58, 62, respectively. The first baffle 42 and second baffle 46 are coupled between the first housing half 34 and the second housing half 38, preferably being stamped or crimped therebetween at the peripheral edges to form a seal and secure the housing 34, 38 and baffles 42, 46 together. In other constructions, the housing 34, 38 and baffles 42, 46 may be coupled, joined or fastened in other ways, such as by way of fasteners or welding. In yet other constructions, fewer or more than two baffles may be employed, and in some constructions, there may be no baffles.

The first housing half 34 defines an exhaust gas inlet 66 to the muffler 26. An exhaust gas outlet 70 is formed at the seam between the first and second housing halves 34, 38 and is collectively defined by the first housing half 34, the second housing half 38, the first baffle 42 and the second baffle 46, as shown in FIG. 2. Exhaust gases enter the first chamber 50 at the exhaust gas inlet 66 and flow from the first chamber 50 to the second chamber 54, from the second chamber 54 to the third chamber 58, from the third chamber 58 to the fourth chamber 62, and from the fourth chamber 62 through the exhaust gas outlet 70, as indicated by arrows 74*a*, 74*b*, 74*c*, 74*d*, 74*e*, 74*f*, 74*g*, 74*h*, 74*j*, respectively.

Figure 3:
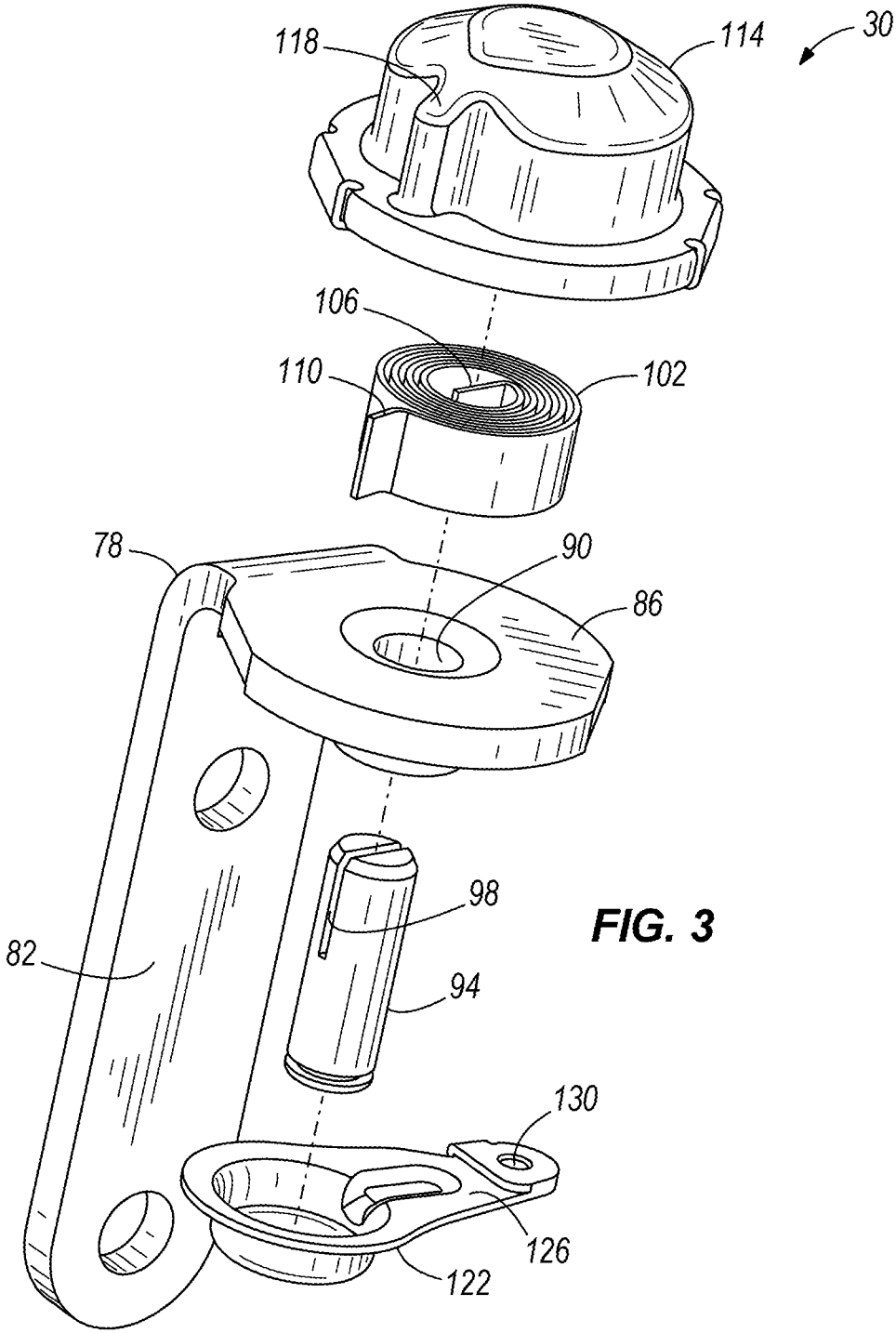
FIG. 3 is an exploded view of the portion of the automatic choke apparatus of FIG. 2.

With reference to FIGS. 2 and 3, the thermally conductive assembly 30 includes a thermally conductive member 78 coupled to the muffler 26. The thermally conductive member 78 extends through the muffler housing 34, 38, in a cantilevered manner, between the interior and exterior of the muffler 26, and is preferably staked or crimped between the first and second housing halves 34, 38 and the first and second baffles 42, 46, as described above. In other constructions, the thermally conductive member 78 may be coupled, joined or fastened in other ways to extend between the interior and exterior of the muffler housing 34, 38.

The thermally conductive member 78 includes a first portion 82 and a second portion 86. The first portion 82 extends between the interior and exterior of the muffler 26 and is fastened or otherwise coupled to the first baffle 42 within the first chamber 50 adjacent the exhaust gas inlet 66. Thus, the first portion 82 is positioned in the interior of the muffler 26 and in direct contact with exhaust gases. The second portion 86 is positioned in the exterior of the muffler 26 and extends from the first portion 82 at substantially a right angle with respect to the first portion 82. Preferably, the first and second portions 82, 86 are formed as one piece; however, in other constructions, the first and second portions 82, 86 may be formed separately and coupled together.

The second portion 86 includes a central aperture 90 that receives a pin 94 having an axial slot 98 partially cleaving the pin 94 in half. A thermally responsive element 102 is coupled to the second portion 86 of the thermally conductive member 78 and receives heat from the exhaust gases by way of conduction through the thermally conductive member 78 and radiation therefrom. In the illustrated construction, the thermally responsive element 102 includes a bimetallic coil. In other constructions, the thermally responsive element 102 may be any appropriate thermal actuator, such as a wax motor, a thermally responsive wire, a bimetallic disk, plastics, etc.

The placement of the thermally responsive device within the engine dictates which type of thermally responsive member is appropriate because conditions vary within the engine 10. Exhaust temperatures rise during engine use to very high levels (upward of 900 degrees Fahrenheit) and thus the thermally responsive member must be able to withstand extreme temperatures for long periods of time. Bimetallic coils can withstand the sustained high temperatures while providing quick (i.e., the coil is reactive to temperature changes) and accurate temperature measurement for actuating the choke. The bimetallic coil 102 may be formed of several known combinations of two metals having different coefficients of thermal expansion or contraction such that the bimetallic coil 120 either expands or contracts in response to the temperature changes in the engine 10.

The thermally responsive element 102 includes an inner end 106 and an outer end 110. The inner end 106 is received by the axial slot 98 of the pin 94 such that the pin 94 retains the inner end 106 of the thermally responsive element 102. The thermally responsive element 102 is enclosed within the second portion 86 of the thermally conductive member 78 and a cover 114. The cover 114 is coupled to the outer periphery of the second portion 86 and includes a recess 118 that receives the outer end 110 of the thermally responsive element 102 to fix a position of the outer end 110 of the thermally responsive element 102. Thus, the outer end 110 of the thermally responsive element 102 is fixed and the inner end 106 is free to move in response to changes in temperature.

As described above, the inner end 110 is coupled to the pin 94. The pin 94 is rotatable within the aperture 90 and is coupled to a lever 122 at an axial end opposite the slot 98. The lever 122 is fixedly coupled to the pin 94 such that the lever 122 rotates with the pin 94. The lever 122 includes a radially extending arm 126 and an aperture 130 at a distal end of the arm 126. As illustrated in FIG. 1, a first end of a linkage 134 is coupled to the arm 126 of the lever 122 at the aperture 130. A second end of the linkage 134 is coupled to the choke valve 22 to move the choke valve 22 in response to movement of the lever 122.

In operation, the thermally conductive assembly 30 acts to automatically operate the choke valve 22 based upon the temperature of the engine 10. The bimetallic coil 102 acts as a thermally-responsive air flow controller in the engine 10 that assures that the choke valve 22 constricts air flow during cold startups to increase the richness of fuel-air mixture and assures that the choke valve 22 remains at least partially open when the engine 10 reaches a predetermined temperature to maximize fuel efficiency and starting performance in the engine 10.

As the engine 10 produces exhaust gases, heat from those gases is conducted by the thermally conductive assembly 30 through a solid material, i.e., the thermally conductive member 78, and transmitted to the coil 102 through thermal contact with the coil 102. As used herein, the word "solid" is defined to mean an object that is not a fluid or a gas. Thus, the heat from the exhaust gases is conducted through the molecules of a solid material, as opposed to through a gas or liquid. The solid material is the conductor of the heat.

The increased temperature in the coil 102 causes the coil to expand or contract, resulting in rotation of the pin 94 and the lever 122. Rotation of the lever 122 moves the linkage 134, which in turn moves the choke valve 22.

This placement of the thermally conductive member 78 in direct contact with the exhaust gases allows for a fast response of the thermally conductive assembly 30 in response to engine temperature to keep the choke valve 22 at least partially open during warm restarts and to move the choke valve 22 quickly in response to heat gain and heat loss.

The physical shape, mass, and materials of the thermally conductive assembly 30 are optimized to create an ideal thermal conducting geometry to transfer heat through the thermally conductive assembly 30 to be proportional to the engine temperatures during starting, warm-up, and cool down. The geometry of the thermally conductive assembly 30 allows for rapid temperature rise and calibrated cool down to address the engine fueling requirements (or, the choking requirements). The physical configuration of the thermally conductive assembly 30 is not only important to help provide fast response of the thermally responsive element 102, it is also important to allow the choke valve 22 to close after an appropriate cool down period when the engine is not running. Thus, the thermally conductive assembly 30 is configured not only for efficient heat conduction, but also for appropriately calibrated heat loss after the engine stops running Thus, the invention provides, among other things, an internal combustion engine having a thermally conductive member in direct contact with exhaust gases inside the muffler to provide accurate control of the choke valve. Various features and advantages of the invention are set forth in the following claims.

We claim:

1. An internal combustion engine, comprising:

a muffler configured to reduce exhaust gas noise, the muffler having a housing defining an interior and an exterior;

a choke valve configured to control a flow of air in a carburetor;

a thermally responsive element coupled with the choke valve and configured to move the choke valve in response to a temperature change in the thermally responsive element;

a thermally conductive member having a first portion positioned in the interior of the muffler and extending through the muffler housing to the exterior of the muffler, and having a second portion positioned exteriorly of the muffler and coupled to the thermally responsive element, the thermally conductive member configured to conduct heat from exhaust gases within the muffler to the thermally responsive element.

2. The internal combustion engine of claim 1, wherein the first portion and second portion substantially form a right angle.

3. The internal combustion engine of claim 1, wherein the first portion is positioned proximate an inlet to the muffler.

4. The internal combustion engine of claim 1, wherein the muffler includes a first clamshell section and a second clamshell section, wherein the thermally conductive member is coupled to the muffler between the first and second clamshell sections.

5. The internal combustion engine of claim 4, wherein the thermally conductive member is at least one of crimped and staked between the first and second clamshell sections.

6. The internal combustion engine of claim 1, wherein the muffler includes an inlet and an outlet for exhaust gases, and wherein the first portion is positioned in direct contact with exhaust gases proximate the inlet.

7. The internal combustion engine of claim 1, wherein the first and second portions of the thermally conductive member are formed as one piece.

8. The internal combustion engine of claim 1, further comprising a linkage, wherein the thermally responsive element is coupled with the choke valve by way of the linkage.

9. The internal combustion engine of claim 1, wherein the thermally responsive element comprises a bimetallic coil.

10. The internal combustion engine of claim 1, further comprising a pin coupled to the thermally responsive element and configured for rotation with the thermally responsive element in response to the temperature change.

11. The internal combustion engine of claim 10, further comprising a lever coupled to the pin for rotation with the pin, wherein the lever is configured to be coupled to a linkage in direct communication with the choke valve.

12. The internal combustion engine of claim 1, further comprising a cover coupled to the second portion and configured to cooperate with the second portion to enclose the thermally responsive element.

13. The internal combustion engine of claim 1, wherein the muffler further comprises an inlet for exhaust gases, an outlet for exhaust gases, a first interior chamber positioned in direct fluid communication with the inlet, a second interior chamber positioned in direct fluid communication with the outlet, at least one wall separating the first and second interior chambers, and wherein the first portion is coupled to the at least one wall and positioned at least partially in the first chamber.

14. The internal combustion engine of claim 1, wherein the thermally conductive member extends through the housing in a cantilevered manner.

15. An internal combustion engine, comprising:

a muffler configured to reduce exhaust gas noise, the muffler having a housing defining an interior and an exterior;

a choke valve configured to control a flow of air in a carburetor;

a thermally responsive element coupled to the choke valve and configured to move the choke valve in response to a temperature change in the thermally responsive element;

a thermally conductive member having a first portion positioned in the interior of the muffler in a thermal exchange relationship with the exhaust gases and extending through the muffler housing to the exterior of the muffler, and having a second portion positioned exteriorly of the muffler and coupled to the thermally responsive element, the thermally conductive member configured to conduct heat from exhaust gases within the muffler to the thermally responsive element.

16. The internal combustion engine of claim 15, wherein the first portion and second portion substantially form a right angle.

17. The internal combustion engine of claim 15, wherein the first portion is positioned proximate an inlet to the muffler.

18. The internal combustion engine of claim 15, wherein the muffler includes a first clamshell section and a second clamshell section, wherein the thermally conductive member is coupled to the muffler between the first and second clamshell sections.

19. The internal combustion engine of claim 15, wherein the muffler includes an inlet and an outlet for exhaust gases, and wherein the first portion is positioned in direct contact with exhaust gases proximate the inlet.

20. The internal combustion engine of claim 15, wherein the thermally responsive element comprises a bimetallic coil.

21. The internal combustion engine of claim 15, wherein the muffler further comprises an inlet for exhaust gases, an outlet for exhaust gases, a first interior chamber positioned in direct fluid communication with the inlet, a second interior chamber positioned in direct fluid communication with the outlet, at least one wall separating the first and second interior chambers, and wherein the first portion is coupled to the at least one wall and positioned at least partially in the first chamber.

22. An internal combustion engine, comprising:

a muffler having a housing defining an interior and an exterior, the interior including an inlet space adjacent a muffler inlet and an outlet space adjacent a muffler outlet;

a choke valve configured to control a flow of air in a carburetor;

a thermally conductive member having a first portion positioned in the inlet space, and a second portion positioned in the exterior of the muffler, a temperature of the thermally conductive member varying in response to the temperature of an exhaust gas passing through the muffler; and a thermally responsive element coupled to the choke valve and to the second portion of the thermally conductive member such that a temperature of the thermally responsive element varies with the temperature of the thermally conductive element, the thermally responsive element positioning the choke valve in response to the temperature of the thermally responsive element.

* * * * *